United States Patent [19]

Saverse et al.

[11] Patent Number: 4,551,241

[45] Date of Patent: Nov. 5, 1985

[54] PARTICLE CLASSIFIER

[75] Inventors: Ronald R. Saverse, Boston; Harold T. Jones, Weymouth, both of Mass.

[73] Assignee: Sturtevant, Inc., Boston, Mass.

[21] Appl. No.: 578,268

[22] Filed: Feb. 8, 1984

[51] Int. Cl.[4] ..... B07B 9/02

[52] U.S. Cl. ..... 209/148; 209/144

[58] Field of Search ..... 209/134, 135, 144, 148, 209/154, 211; 55/204; 210/512.3, 512.1

[56] References Cited

U.S. PATENT DOCUMENTS

| | | | |
|---|---|---|---|
| 2,010,128 | 8/1935 | Arnold | 209/144 |
| 2,276,761 | 3/1942 | Carey | 209/144 |
| 2,313,256 | 3/1943 | Morgan | 209/134 |
| 2,753,996 | 7/1956 | Kaiser | 209/139 |
| 2,795,329 | 6/1957 | Schaub | 209/139 |
| 3,015,392 | 1/1962 | Rozsa et al. | 209/144 |
| 3,036,709 | 5/1962 | Mansson et al. | 209/144 |
| 3,040,888 | 6/1962 | Hosokawa et al. | 209/144 |
| 3,219,185 | 11/1965 | Doyle | 209/139 |
| 3,423,034 | 1/1969 | Hippert | 241/51 |
| 3,426,513 | 2/1969 | Bauer | 209/144 |
| 3,433,422 | 3/1969 | Guenther | 209/144 |
| 3,458,038 | 7/1969 | Young | 209/3 |
| 3,476,244 | 11/1969 | Schauer | 209/139 |
| 3,524,544 | 8/1970 | Jager | 209/139 |
| 3,615,008 | 10/1971 | Alpha | 209/139 |
| 3,669,265 | 6/1972 | Conley | 209/144 |
| 3,670,886 | 6/1972 | Hosokawa et al. | 209/139 |
| 3,891,543 | 6/1975 | Wessel | 209/144 |
| 4,059,507 | 11/1977 | Nobuo | 209/148 |
| 4,211,641 | 7/1980 | Jager | 209/144 |
| 4,279,743 | 7/1981 | Miller | 209/211 |
| 4,296,864 | 10/1981 | Misaka et al. | 209/144 |

FOREIGN PATENT DOCUMENTS

| | | |
|---|---|---|
| 510269 | 4/1952 | Belgium . |
| 647888 | 7/1937 | Fed. Rep. of Germany . |
| 497966 | 1/1939 | United Kingdom . |

OTHER PUBLICATIONS

Letter dated 2/22/79 to Gulf Coast Portland Cement from Sturtevant Mill Company transmitting assembling instructions and drawing for Sturtevant Air Separator including attachments.

Article entitled "Air Classifiers" by Ivan V. Klumpar and Terry A. Ring, undated and not published.

Product brochure, "O-SEPA High Performance Air Separator from Fuller", Fuller Company, Bulletin FSB-2M.

Product brochure, "Centri-Sonic TM Classifier", The Bauer Bros. Co., 1971, Bulletin G-8D.

Product brochure, "Cyclone Air Classifier", Humboldt Wedag, 5/1976.

*Primary Examiner*—Charles Hart

*Attorney, Agent, or Firm*—Kenway & Jenney

[57] ABSTRACT

A particle classifier includes a generally cylindrical, air and fine particle permeable cage having a closed top and open bottom mounted to a central drive shaft. A casing surrounds the cage and defines a volute air passage about the cage with an air separation zone between the volute and the cage. A generally tangential air inlet is provided in the casing volute and a material inlet is provided in the upper end of the casing. A stationary chamber is positioned below the cage for the air and fine material which enter the cage. From the chamber, the air and fine material is directed to cyclone separators in which the air is separated from the particles. A hopper is positioned below the chamber for collecting coarser material which fails to enter the cage. The size of the volute can be adjusted by a vertical partition within the casing. The partition allows flexibility in setting the air velocity. Means are provided for streamlining the air flow from the air inlet to the cage and retaining particles in the separation zone. In one case, louvers are provided for these two purposes, and in another case a screen is provided between the volute and particle separation zone.

7 Claims, 5 Drawing Figures

14
60
62
45
42
43
48
40
44
58
79
12
64
46
72
66
38
20
72
68
70
50
54
52
56
3
3
24
36
46
76
26
26
26
41
22

26
66
26
16
68
44
54
50
56
70
72
38
76
77
46
20
26
26

40
60
79
62
48
79
64
20
70
38
72
74
36
24
46
77
76
46
50
78
26
26
26

PARTICLE CLASSIFIER

DESCRIPTION

1. Technical Field

This invention relates to particle classifiers and in particular to classifiers in which particulate material is dropped into a separation zone between a volute air inlet passage and a rotating rejector which receives fine particles.

2. Background

The present invention is applicable to the processing of any solids but is particularly useful in cement manufacturing plants. In such plants, it is important to separate fine particulate material from coarser material.

In one form of particle classifier, a separation zone is provided between an inlet air passage and a rotating rejector cage. From the air passage air is directed through the separation zone into the rotating rejector cage. A mixture of fine and coarser material is fed into the separation zone by gravity. Coarser material drops through that separation zone and is collected through a hopper. Finer material is carried by the air flow into the cage and is subsequently drawn from the cage and separated from the air flow in a cyclone collector.

In one form of classifier, the inlet air passage is in the form of a volute into which the air is introduced tangentially. The outer wall of the volute spirals inward through a single circle about the rejector so that the cross sectional area of the volute across the air stream is reduced as the air flows about the rejector. The volute causes the air to curve inward through the separation zone into the rejector cage.

The size of particles carried into the cage is a function of several forces on particles of different size, density or shape. Those forces include particularly gravity, the drag force of the air on the particles, the collision force of particles impacting the rotating rejector and centrifugal forces imparted on the particles either by the rotating air or by mechanical devices or both. Further, sharpness of classification and the efficiency of classification are dependent on the precision of control of those various forces. It is of course preferred that all particles smaller than a given size enter the rejector cage and all particles larger than that size pass through the hopper and that a minimum of power input be required.

The disadvantage of the existing classifiers is that, in full-size industrial equipment, the volute is large and the air flow through it is difficult to control. Instead of moving laminarly, the air forms local currents and eddies that disrupt the required smooth radial flow into the rejector cage and interfere with the even distribution of air over the cylindrical rejector surface. Attempts have been made to correct this problem by providing vertical vanes in the volute and horizontal blades in the cage. However, the vanes are not effective if the air is brought to the volute by a duct with a horizontal bend close to the volute or pumped by a centrifugal fan close by, which is the case in the majority of plants. The duct bend or fan cause a vertically scewed velocity profile of the air in the duct that cannot be corrected by vertical vanes. The blades are not effective because they are downstream from the separation zone.

Another disadvantage of the existing classifiers is that some of the particles descending through the separation zone around the rejector cage are always thrown outward beyond the separation zone either by a rotary distributor on top of the zone, or by local currents of the non-laminar air flow, or by collision with other particles, or by being bounced off too far by the rejector. Some of these particles deposit at the bottom of the volute close to the vertical outside wall where the tangential air velocity is small. Once the particles deposit the air cannot act on them to separate the fine particles from the coarse particles. While coarser particles settle down preferentially, they trap finer particles among them. The deposit continuously slides down to the hopper and is replenished by more particles settling down, thus contaminating the coarse product with fine particles and decreasing classification efficiency. Attempts have been made to prevent the particles from settling or to reduce the deposit by increasing the volumetric air flow rate. However, this requires more power to pump the air and increases carry-over of coarse particles in the fine product by raising the radial air velocity into the rejector cage.

Yet another disadvantage of existing classifiers is that the rejector is an assembly of vertical and sometimes also additional horizontal blades. The purpose of the latter is to streamline the air while the number and size of the vertical blades control the amount of remaining coarse particles in the fine product. However, changing the number of, or replacing, the vertical blades is difficult because there is no easy way of pulling out or reinstalling the blades without at least partially disassembling the classifier. Furthermore, rotating blades, more so than stationary vanes, are subject to fast erosion due to their large area to thickness ratio when an abrasive material is classified. The streamlining effect of the horizontal blades is not very effective because the air turbulence that interferes with classification is caused upstream from the separation zone while the blades are downstream.

An object of this invention is to provide a sharper and more efficient classification in a volute type of classifier and better control of solids processing.

DISCLOSURE OF THE INVENTION

In furtherance of the object of this invention, one particle classifier embodying this invention includes a generally cylindrical, air and fine particle permeable rejector cage mounted to a central drive shaft for rotation by the drive shaft. The rejector cage is surrounded by a volute wall which defines a volute air passage about the cage.

The cage may include a top distributor plate and an assembly of vertical pins which serve as a rejector. The pins may be removable from the cage through an access port in the top of the classifier. Wear resistant sleeves may be placed about the pins or bigger pins may be used for classification of abrasive materials.

The volute wall has at least one generally tangential air inlet. Separation occurs predominantly in a narrow zone adjacent to the rejector. This three dimensional annular space around the rejector is referred to as separation zone. Louvers in the form of stacked concentric horizontal annular plates or cones may extend inward to the separation zone to control the flow characteristics of air moving in the volute. Specifically, turbulence in the air flow, including local currents and eddies, is minimized. This is referred to as streamlining.

Furthermore, the louvers prevent particles from depositing at the bottom of the volute. Horizontal louvers retard the drop-out of particles by providing several levels at which the particles might be picked up by the air again. Conical louvers are even more efficient because they make the particles slide back to the separation zone along the inclined surfaces. Also, if the individual cones properly overlap, the particles can never penetrate to the outside volute wall.

In another form of particle classifier embodying principles of this invention, the incoming air flow is streamlined by a screen between the volute and the particle separation zone. The openings in the screen make up at least 50 percent, and preferably over 70 percent, of the cylindrical surface area defined by the screen. Thus, the screen serves to streamline the air flow without unduly restricting the air flow.

Furthermore, the screen retains the particles in the separation zone and prevents them from depositing at the bottom of the volute. This is effected by two facts. Particles that are thrown outward are either bounced back by the solid part of the screen or swept back by the local high velocity of the air flowing through the screen openings.

A better control of the tangential air velocity in the volute is provided by including a generally vertical partition within the volute. The partition defines a smaller volute air passage which induces a higher tangential air velocity component without the need for a higher volumetric flow rate of air and without affecting the radial component. A higher flow rate would require a larger fan and more power while the increased radial velocity into the rejector cage might interfere with the separation process.

The louvers, screen and partition provide elements for a flexible design of more efficient equipment with a sharper classification capability. The elements may be used separately or combined, e.g., louvers with partitions. Alternatively, various types of louvers, screens and partitions may be provided for replacement during plant shutdown to adjust the classifier to changes in process parameters such as variations in feed available and/or product required.

Furthermore, the three elements can be designed so as to be adjustable during operation either manually or as a part of an automatic process control in response to changes in process parameters. For example, the vertical partition can be made of several segments to allow expansion or contraction in the radial direction for increasing or decreasing the cross sectional area of the volute. The number and angle of louvers can be changed by making them of segments that can be turned or collapsed flat against the volute ceiling. Screen openings can be expanded or contracted by various means, e.g., by providing two adjacent perforated plates, one stationary and the other movable in the horizontal direction.

BRIEF DESCRIPTION OF THE DRAWINGS

The foregoing and other objects, features and advantages of the invention will be apparent from the following more particular description of preferred embodiments, as illustrated in the accompanying drawings in which like reference characters refer to the same parts throughout the different views. The drawings are not necessarily to scale, emphasis instead being placed upon illustrating the principles of the invention.

DESCRIPTION OF PREFERRED EMBODIMENT

Figure 1:
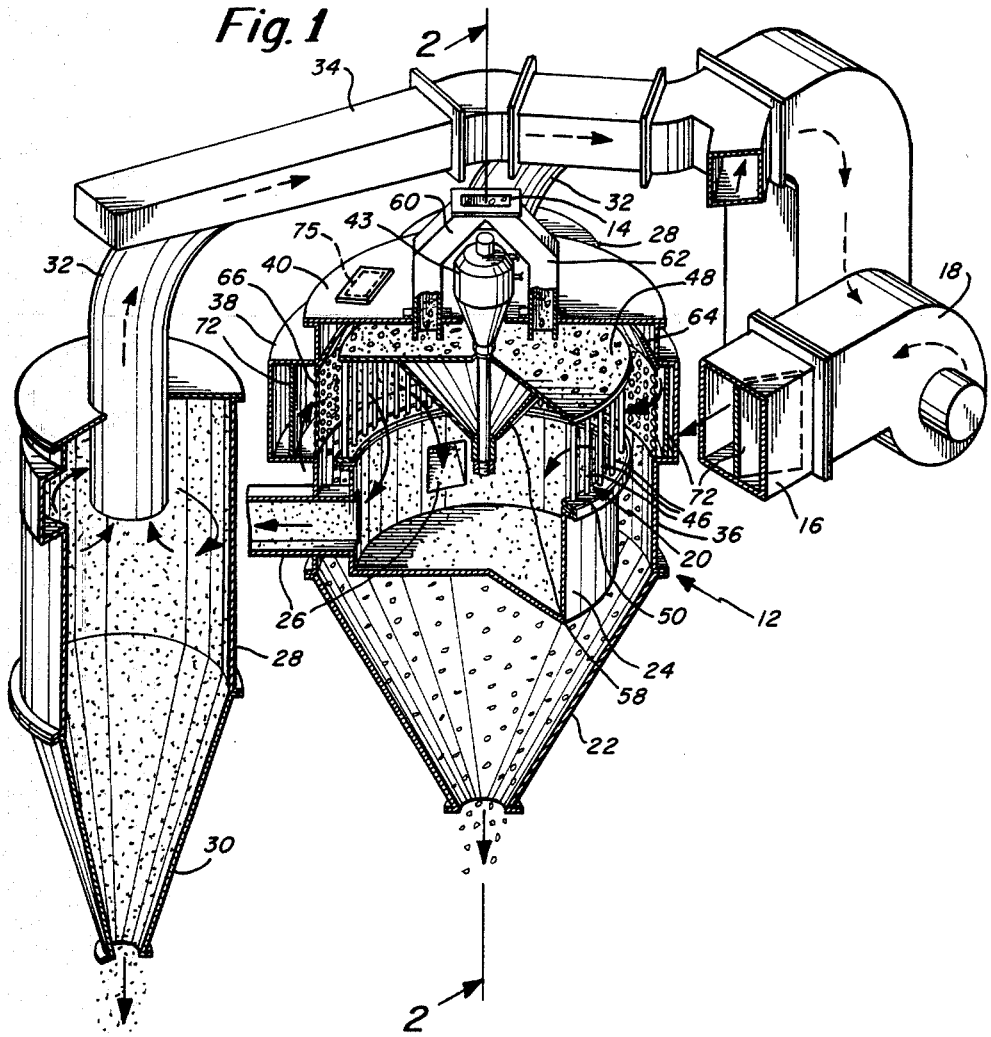
FIG. 1 is a perspective view, partially broken away, of a particle classifier embodying certain principles of this invention including a partition and volute screen.

FIG. 1 illustrates the primary elements of a system embodying this invention. At the heart of this system is a classifier 12 which will be described below. Particulate material, including fine and coarse material which are to be separated, are delivered to the classifier 12 through an inlet conduit 14. Air is forced into a tangential inlet 16 by a blower 18. By action of the air flow and rotation of a rejector cage 20 within the classifier, fine material is carried into the cage and coarser material or tails drop alongside the cage into a discharge hopper 22. The fine particles are carried into a stationary fines chamber 24 below the cage 20 and are carried with the air flow through a plurality of outlet conduits 26 to several cyclone collectors 28. The number of cyclones depends on the capacity of the system. In the cyclones, the fine material is separated from the air flow and the fine product drops into discharge hoppers 30. The particle free air is returned through upward extending conduits 32 into a manifold 34 which returns the air from the several cyclones to the blower 18 for reuse in separating fine material from coarser material.

Figure 2:
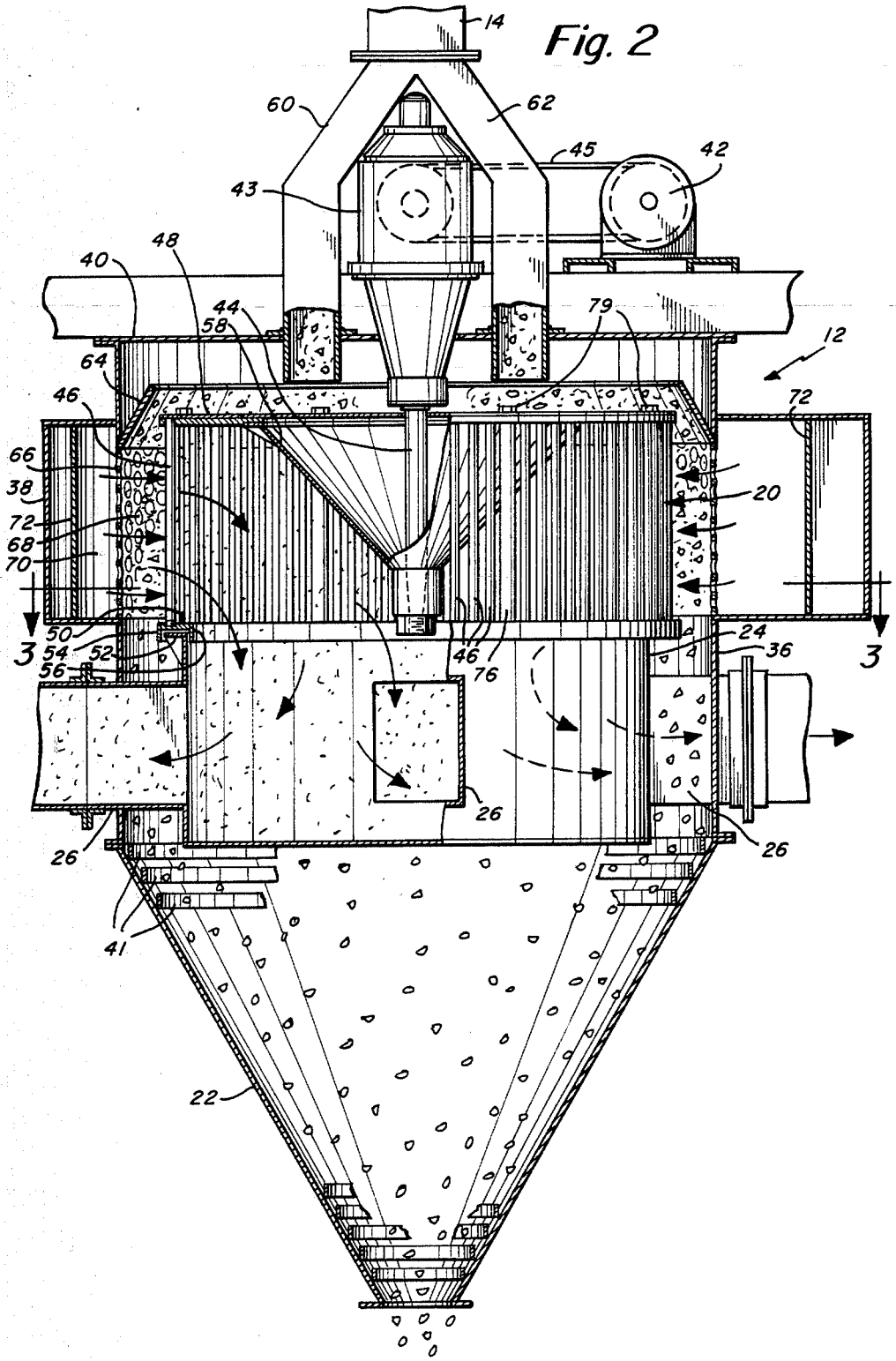
FIG. 2 is a vertical cross section of the embodiment of FIG. 1 taken along lines 2—2.
Figure 3:
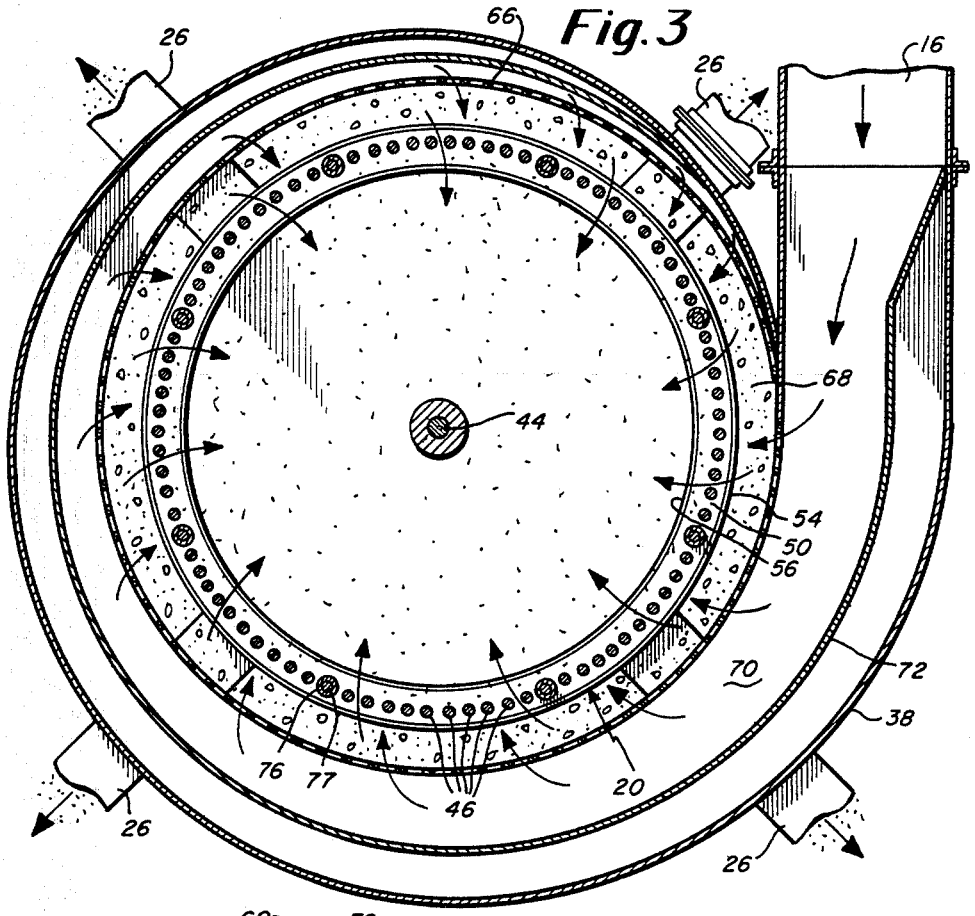
FIG. 3 is a horizontal cross section of the embodiment of FIG. 1 taken along lines 3—3.

Details of the classifier 12 can be best seen in the cross sectional views of FIGS. 2 and 3. The outer casing of the classifier includes the hopper 22, a cylindrical section 36 above the hopper which directs separated coarser material to the hopper, a volute casing 38 and an upper cover 40. The stationary chamber 24 is suspended within the cylindrical section 36 by the outlet conduits 26.

A number of vertical ring liners 41 are fixed to the hopper 22 to collect material. That collected material isolates the hopper 22 surface from the falling material and thus minimizes wear.

A motor 42 and gear reducer 43 are mounted above the cover 40. The reducer is driven by a belt 45. A shaft 44 driven by that motor extends into the volute casing concentric with the cylindrical section 36 and the hopper 22. The rejector cage 20 is mounted to the shaft for rotation by the motor. The cage includes a plurality of pins 46 extending vertically between an upper distribution plate 48 and a lower ring 50. The lower ring 50 is suspended above a flange 52 on the stationary chamber 24. Two guide rings 54 and 56 extend downward from the ring 50 to assure that the rotating cage remains concentric with the collection chamber.

A conical section 58 provides structural support of the cage on the drive shaft 44. It also serves as a directional element to deflect air flow and the fine material carried by the air flow downward through the ring 50 into the stationary chamber 24.

The size and number of pins control the amount of coarse particles remaining in the fine product. The lower part of each pin rests in a blind tapped hole 78 located on the bottom ring 50 of the rejector cage. The upper part of the pin extends through a hole drilled in the distributor plate 48. The top of the pin is flush with the upper surface of the distributor so as not to interfere with the feed distribution.

A pin can be easily removed manually or with a set of special tools through a port 75 in the top cover 40 of the classifier. This is done by grabbing the pin in the middle, lifting it, grabbing the top and pulling the entire pin out. The cage is then turned until the next pin to be removed is under the port, and the pulling process is repeated. For inserting pins, the process is reversed.

A minority of pins, typically eight out of 48 for a two-foot diameter rerejector cage, are used to hold spacers 76 that establish a constant distance between the distributor plate and the bottom ring. The spacer is a piece of tubing through which the spacer pin is slipped during insertion. The spacer pins 77 have a threaded bottom that fits into a threaded blind tapped hole 78. The top of the pin extends above the distributor and is also threaded. A nut 79 screwed tightly on the top of the pin holds the spacer in position.

Size of the regular, non-spacer pins can be increased by "loose" spacers, that is pieces of tubing not individually held in position by a top bolt. They are, of course, fixed by tightening the bolts on the spacer pins. The size of any pin can be varied by using bigger or smaller spacers. For classification of abrasive materials, all pins may be protected by abrasion resistant spacers or bigger pins may be provided that resist wear longer.

Particulate feed material introduced into the system through the conduit 14 is divided into two or more conduits 60 and 62, and from those conduits the material is dropped onto the rotating distribution plate 48. Centrifugal force imparts radial motion to the material so that it slides off the periphery of the distribution plate. The material is then deflected downward by a frustoconical deflector 64 to create a curtain of particulate material which descends around the cage through the separation zone.

In this embodiment, a cylindrical screen 66 is stretched between the deflector 64 and the cylindrical casing section 36 to surround the cage 20. The screen may be a mesh or a perforated sheet. The screen 66 defines a separation zone 68 between an outer volute air passage 70 and the cage 20. Air, which initially enters the volute air passage 70 tangentially, curves in through the screen and then through the rotating cage 20. In the separation zone 68, the air flow has both tangential and radial components.

Within the separation zone, the particles of material are subjected to a number of countering forces which affect the heavier and lighter materials differently. Initially, as the material is thrown from the distribution plate 48, the coarser particles have greater inertia and thus tend to be thrown further from the distribution plate. Below the deflection plate 64, the particles are subjected to a drag force from the air flow which entrains the particles in the air flow. As noted above, a component of that air flow is tangential and the larger centrifugal force of the coarser particles again pulls them to a wider radius than the finer particles. The particles are also pulled down by gravity.

Coarser particles are held away from the cage 20 by their inertia as they drop the full distance through the separation zone 68 and enter the cylindrical casing 36. From the casing 36 those coarser particles enter the hopper 22. Fine and medium particles, on the other hand, are pulled into the cage 20 by the air flow before they drop to the bottom of the separation zone. Some of those particles, particularly the medium sized particles, are rejected by the rotating pins back into the separation zone where they are again entrained in the air flow and continue to drop towards the cylindrical casing 36.

Coarse particles may carry smaller particles with them into the hopper 22. If the coarse particles are retained in the separation zone 68 throughout their fall to the cylindrical section 36, there is a greater chance that those smaller particles will be separated from the coarse particles and be carried into the rejector cage. The screen 66 retains the particles within the separation zone for better separation. The solid portions of the screen deflect material back into the separation zone. The screen also locally increases the velocity of the air flow at the outer perimeter of the separation zone 68. That local increased air velocity at the screen perforations also helps direct material back into the separation zone 68.

It can be recognized that turbulence in the air flow within the volute air passage 70 and the separation zone 68, including local currents and eddies, adversely affects the precision and efficiency of the system. The screen 66 serves the further function of streamlining the air flow into the separation zone 68 by breaking the air flow into a sheet of minute jets through the perforations in the screen. By breaking the air flow into the minute jets, turbulence is broken up and the overall air flow is made more uniform about the entire periphery of the separation zone 68. It is important, however, that the screen not significantly interfere with the tangential component of the air flow introduced by the volute air passage 70. Therefore, it is important that the screen be at least 50 percent open to the air flow, that is, at least 50 percent of the cylindrical surface defined by the screen should be open to air flow. Preferably, greater than 70 percent of the screen surface area is open.

The overall result of the countering forces in the separation zone is that fine material is carried by the air flow between pins 46 into the cage and is then deflected downward by the conical directional element 58. The air and fine material enter the stationary chamber 24 and are divided into several conduits 26 which lead to the cyclone separators 28. As previously stated, the air is there separated from the fine material, and the air is returned to the blower 18 for recirculation through the classifier.

It can be recognized that the sharpness of classification, that is the degree to which one can expect only material less than a given size to pass into the cage 20 and only material greater than that size to drop into the hopper 22, the efficiency of the system and the capacity of the system are dependent on a number of variables. Those variables include the size, shape and density of material entering the system, the rotational speed of the cage 20, the volumetric flow rate of air entering the system, the tangential and radial components of air velocity throughout the separation zone 68 and the number and size of the pins 46. In conventional systems, many of those parameters can be controlled by controlling the speed of the rejector motor 42 and the flow of air delivered by blower 18.

One aspect of the present system is that the tangential velocity of air in the volute 70 and thus in the separation zone 68 can be controlled independently of the air flow set by the blower 18. By controlling the tangential air velocity, one can control the size of particles that are thrown outside of the separation zone. With a higher air velocity, less particles escape the separation zone to slide down to the cylindrical casing 36. The air velocity also controls the time that particles are entrained by the air flow in the separation zone. To that end, a partition 72 is mounted in the volute casing 38 to define a smaller volute air passage about the separation zone 68. By moving that partition inward, the cross sectional area of the volute air passage is decreased and the air velocity is increased. Moving the partition 72 outward decreases the air velocity where other parameters are held constant.

The partition 72 allows for construction of the basic classifier with an outer casing wall 38 defining the largest volute that would be required for any expected application. For example, the outer volute would allow for a given classification size from a given size range of particles entering the system at a given density. The partition 72 can then be set in the volute at an optimum position for any other particular application. Partition 72 may be welded into position where the application is to remain constant. Where the application is to vary, the partition 72 can be collapsible within the volute casing in order that the volute passage 70 can be varied for the varying applications. In either case, the partition 72 introduces one more design parameter which can be controlled to optimize operation of the classifier.

Figure 4:
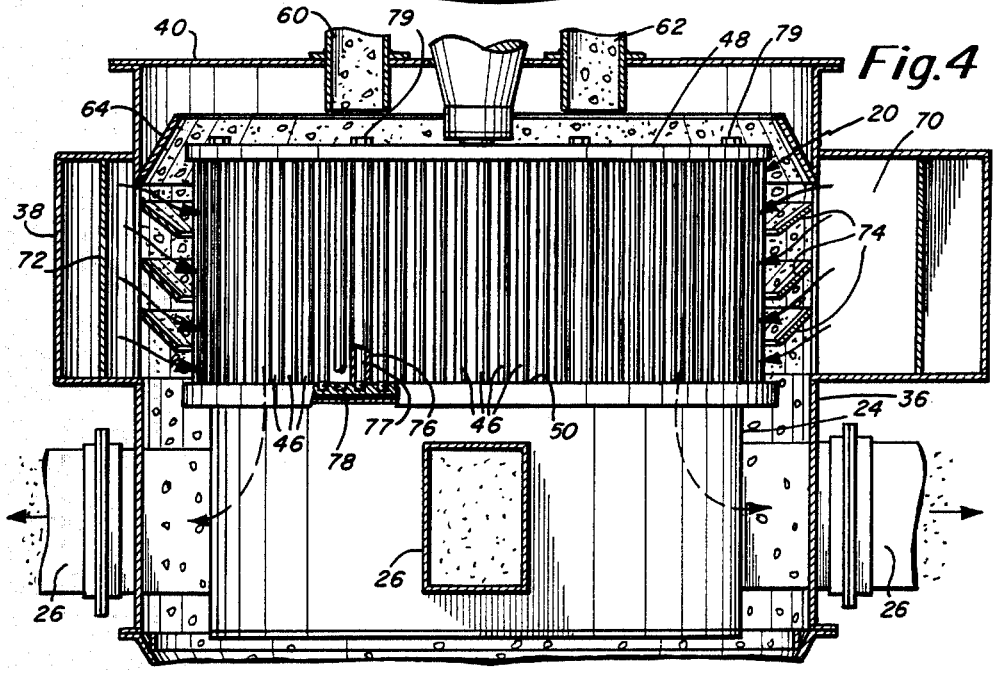
FIG. 4 is a vertical cross section of an alternative embodiment of the invention including a partition and inclined louvers.
Figure 5:
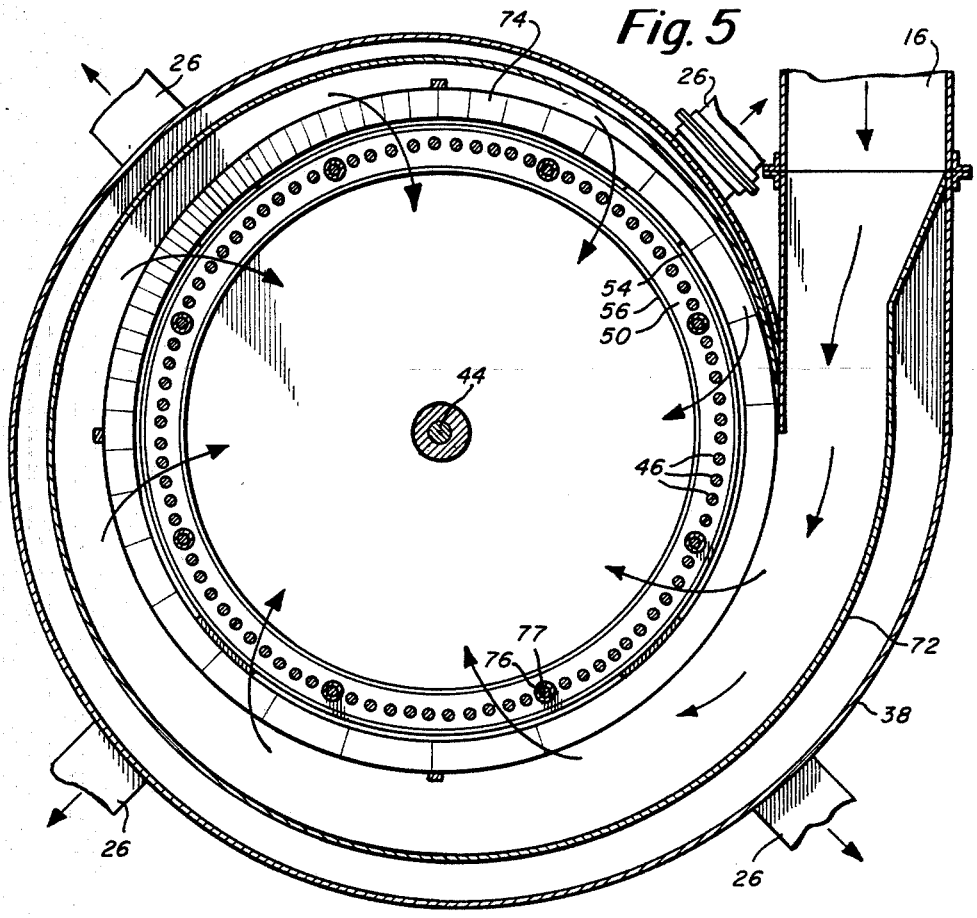
FIG. 5 is a horizontal cross section of the embodiment of FIG. 4.

An alternative embodiment of the invention is shown in FIGS. 4 and 5. This embodiment is much the same as that of FIGS. 1 through 3 except that a different means is used to eliminate turbulence in the air flow. In this embodiment, the screen 66 is eliminated and louvers 74 are mounted within the volute air passage. Those louvers can be seen to extend inward, generally parallel to the air flow in the volute air passage. They thus break the air flow into several streams and thereby minimize turbulence in the overall stream and equalize the air velocity throughout a cross section of the volute air passage.

For ease in manufacturing, the louvers are regular cones which touch the outer volute wall only at the narrowest section of the volute. The inner edges of the louvers are at about the outer radius of the separation zone. The louvers 74 can be horizontal, but by angling them downward somewhat as shown in FIG. 4, they can also serve the function of directing any material which passes beyond the separation zone back into the separation zone. In this case, the louvers may be angled 45° from the vertical.

While the invention has been particularly shown and described with reference to preferred embodiments thereof, it will be understood by those skilled in the art that various changes in form and details may be made without departing from the spirit and scope of the invention as defined by the appended claims. For example, the streamlining screen 66 and louvers 74 have been shown in conjunction with the volute partition 72. However, each of those features of the system could be used advantageously in a system which does not include the partition 72, and the partition can be used without either the screen or louvers.

We claim:

1. A particle classifier comprising:

a cylindrical rejector cage mounted for rotation about its cylindrical axis having an open bottom and a disc-shaped top;

drive means located above said rejector cage for imparting rotation thereto;

feed material inlet means for directing feed material to the said top of said rejector cage for centrifugal dispersion;

means defining an annular separation zone immediately surrounding said cylindrical rejector cage;

air passage means for directing air around and radially inward through said separation zone toward said rejector cage so as to blow said feed material against said rejector cage;

coarse hopper means coaxially disposed below said separation zone for receiving course material rejected by said rejector cage;

a cylindrical stationary fines chamber coaxially disposed immediately below said rejector cage surrounded by said coarse hopper, said fines chamber having an open top a side wall and a closed bottom;

a plurality of outlet ports defined in the side wall of said fines chamber;

a plurality of corresponding openings in said coarse hopper;

a plurality of outlet ducts connected to said fines chamber side wall at said outlet ports and extending sealingly through said corresponding openings in said coarse hopper;

said fines chamber being supported primarily by said ducts so as to be suspended in said coarse hopper coaxially below said rejector cage.

2. The particle classifier of claim 1 wherein said rejector cage includes a vertical coaxial drive shaft drivingly connected to said drive means having a free lower end extending in the direction of said fines chamber;

a horizontal disc coaxially mounted to said shaft, a plurality of elongated vertically disposed spaced elements suspended from the circumference of said disc, the lower ends of said elements being connected to a ring-like member juxtaposed with the upper portion of the side wall of said fines chamber.

3. The particle classifier of claim 2, wherein said rejector cage further includes support means extending diagonally outward and upward from the lower portion of said shaft to a radially intermediate point on said disc.

4. The particle classifier of claim 3, wherein said support means is a coned-shaped wall with its apex connected to the lower portion of said shaft.

5. The particle classifier of claim 1 further comprising a plurality of cyclone means connected to respective ones of said ducts for evacuating the fines from said fine chamber.

6. The particle classifier of claim 1, wherein said outlet ports are equally circumferentially distributed.

7. The particle classifier of claim 6, wherein there are four equally circumferentially spaced outlet ports in said fines chamber.

* * * * *